US006421840B1

(12) United States Patent
Chen et al.

(10) Patent No.: US 6,421,840 B1
(45) Date of Patent: Jul. 23, 2002

(54) SOFT SHELL PROTECTIVE HEAD GEAR AND FABRICATION METHOD

(75) Inventors: Chien-Fang Chen; Shyan-Wei Chen, both of Taipei (TW)

(73) Assignee: Racer Sporting Goods Co., Ltd., Taipei Hsien (TW)

( * ) Notice: Subject to any disclaimer, the term of this patent is extended or adjusted under 35 U.S.C. 154(b) by 0 days.

(21) Appl. No.: 09/845,184

(22) Filed: May 1, 2001

(30) Foreign Application Priority Data

Nov. 15, 2000 (TW) ..... 89124137 A

(51) Int. Cl.[7] ..... A42B 1/06

(52) U.S. Cl. ..... 2/410; 2/172; 2/183; 2/411; 2/418

(58) Field of Search ..... 2/410, 6.1, 423, 2/172, 183, 205, 425, 411, 417, 418

(56) References Cited

U.S. PATENT DOCUMENTS 1,841,232 A * 1/1932 Wells ..... 2/6.1
4,548,665 A 10/1985 Morin ..... 156/197
4,843,642 A * 7/1989 Brower ..... 2/414
4,845,782 A * 7/1989 Gregg ..... 2/172
5,729,830 A * 3/1998 Luhtala ..... 2/195.1
6,088,840 A * 7/2000 Im ..... 2/411

FOREIGN PATENT DOCUMENTS

CN 249749 4/1983

OTHER PUBLICATIONS

Simpson, J. Trauma, vol. 29, pp. 1519–1525, 1989.

Lee Mao–chang et al, Chinese Medical Bulletin, vol. 14, Issue 2, pp. 119–129, 1994.

* cited by examiner

*Primary Examiner*—Rodney M. Lindsey
(74) *Attorney, Agent, or Firm*—Jacobson Holman, PLLC

(57) ABSTRACT

This innovative "soft shell protective head gear fabrication" is characterized in hot-compression forming of shock-absorption inertia foam rubber, foam rubber and hard plastic platelet, which are then cut and sewn to complete a soft shell protective headgear with an appearance of hawksbill turtle shell but without a hard casing.

3 Claims, 8 Drawing Sheets

SOFT SHELL PROTECTIVE HEAD GEAR AND FABRICATION METHOD

BACKGROUND OF THE INVENTION

1. Field of the Invention

This invention discloses a protective headgear with the appearance of hawksbill turtle shell but without a hard casing, made by hot-compression forming of shock-absorption inertia foam rubber, foam rubber and hard plastic platelet, which are then cut and sewn to complete a soft shell protective headgear with an appearance of hawksbill turtle shell but without a hard casing.

2. Background of the Invention

In many occasions of our daily life, we have to use hats, caps or helmets to protect our heads. With increasing danger, people feel increasing need to protect their heads. For example: riding a motorcycle or bicycle, in ice hockey, horseracing, car driving and passengers, they all need different protection to their head under different circumstances.

The conventional safety helmet has a hard casing. People believe in such conventional hard helmet, because a hard shell could avoid damage to the head when it is subjected to impact from a hard or sharp object. As indicated in 1989 in a study done by Simpson DA and others published in page 1519–25, Volume 29 of the publication J. Trauma, as well as in 1994 in a study done by Lee Mao-chang, Chang Li-dong and others published in page 119–29, issue 2, volume 14 of Chinese Medical Bulletin, it has been found that extremely rigid helmet is not only hazardous to human brains, but also the cause for transmission of impact to the cervical vertebra, which could result in fatal fracture of skull base and pontomedullary tears between pons and the spinal cord. Apparently, a working helmet with excessively hard shell could transmit the impact to the skull and cervical vertebra, resulting in damage to the brain and injury to the skull base or the cerebral vertebra of the helmet wearer.

People worldwide use motorcycles and automobiles for transportation. The total number of motorbikes and cars worldwide has soared to several billions. Most motorcycles travel almost at the same speed as cars, but motorcycles lack structural design for steadiness, protection of bikers. Therefore, traffic regulations have provided that bikers and passengers must wear helmets to protect their head. However no regulation has yet been specified to require car drivers and passengers to wear their helmet and protect their heads. But from the above information, we can know that conventional hard helmets could bring impact to the skull and cerebral vertebra of the driver and passengers, which may result in injury to the wearer's brain, skull base or cerebral vertebra.

3. Prior art

Conventional production of hard-shelled working helmets and safety helmets involves the use of fibers containing or soaked with resin which are weaved into fiber pre-soaked fabrics, before they are molded to form.

For example, as disclosed in the Patent No. 249749 of the Patent Gazelle of the Republic of China (Taiwan), the production of hard-shelled working helmets and safety helmets involves soaking of epoxy resin, carbon fiber, glass fiber, and Kuwela fiber, which are then woven into fiber pre-soaked fabrics, before they are cut, pasted to prototype and molded to form. The fiber pre-soaked fabrics are then pasted onto the hard shell. As disclosed in U.S. Pat. No. 4,548,665, a HONEYCOMB formulation is introduced to produce safety helmet with an arched surface and hard insert. It involves the production of a HONEYCOMB hard insert with an arched surface, which is filled into the hard shell.

Helmets are worn on the head to protect the brain in human activities involving possible impact, such as operating a motorcycle, car, or sports like ice hockey, soccer, rugby, American football, ice skating, horseracing taekwondo, etc. The inventor has full understanding of the shortcomings of conventional safety helmets or working helmets with hard casings, which may bring the impact produced in an accident to the skull and cerebral vertebra, causing possible damage to the wearer's brain, skull base or cerebral vertebra. Therefore, the inventor has developed a protective helmet that looks like a hawksbill turtle shell, to protect our heads from injury.

BRIEF DESCRIPTION OF THE INVENTION

The primary objective of this invention of "fabrication of helmet with a flexible shell" is to disclose an innovative production, characterized in hot compression of shock-absorption inertia foam rubber, foam rubber and rigid plastic platelets, which are then cut and sewn to become a protective helmet shaped like a hawksbill turtle shell without a hard casing.

Another objective of this invention is to equip each single platelet of hawksbill bill turtle shell protrusion with some features, which are lacking in conventional safety helmets or hard working helmets. The flexible protective helmet can divert impact force, so that it does not expand to other hawksbill turtle shell protrusion. When impact is applied on any protrusion on the flexible protective helmet, the protruded block subjected to force will absorb the impact individually.

Another objective of this invention is lies in that, the soft-shelled protective helmet produced this the subject fabrication has no hard casing as seen in conventional helmets. Therefore, it can avoid the transmission of force to the user's skull and cerebral vertebra, and prevent the user from injury to the brain, skull base or cerebral vertebra.

Those skilled in the art will definitely gain full understanding of the objective and advantages of this invention, after they have carefully read the following detailed description of preferred embodiment and drawings.

BRIEF DESCRIPTION OF DRAWINGS

The drawings of preferred embodiments of this invention are described in following details to enable better understanding.

FIG. 4-1 illustrates single-layered structure.

FIG. 4-2 illustrates double-layered structure.

FIG. 4-3 illustrates multiple-layered structure.

BRIEF DESCRIPTION OF NUMERALS

Figure 1:
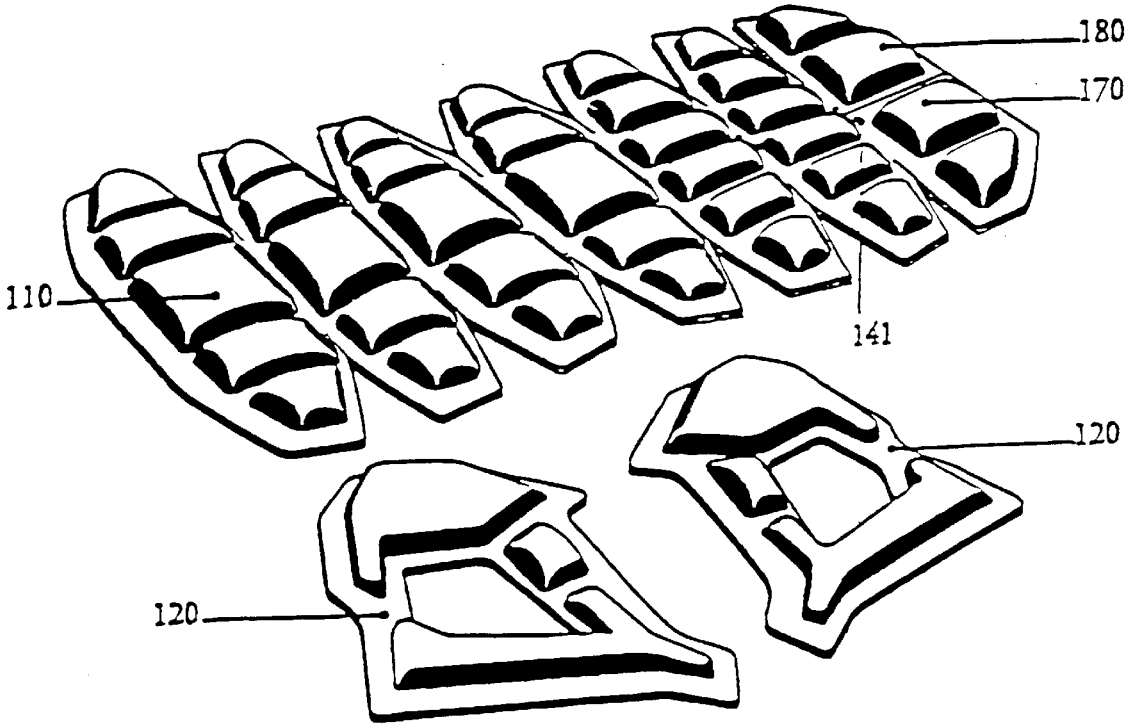
FIG. 1 is a perspective view of the fundamental protruded blocks.

110 . . . fundamental protruded blocks

111 . . . external layer of shock-absorption foam rubber

112 . . . hard plastic platelet
113 . . . internal layer of shock-absorption foam rubber
114 . . . external layer
116 . . . bottom layer
120 . . . protruded ear block
130 . . . fastening band
131 . . . band ring
132 . . . fixing ring
140 . . . tightening knot
141 . . . tightening hole
150 . . . main protrusion
160 . . . connecting band
170 . . . tail protrusion
180 . . . tail protrusion
190 . . . margin

DETAILED DESCRIPTION OF PREFERRED EMBODIMENTS

This invention of "soft-shelled protective helmet" is characterized in that, each protruded block of hawksbill turtle shell has a feature that is lacking in conventional safety helmet or working helmet with a hard shell. This innovative soft-shell helmet can divert force applied on it and absorb the impact. Therefore, the impact applied on any protruded block of the soft-shell helmet will not be extended to other protruded blocks of the turtle shell; thus enabling the user to avoid transmission of excessive impact to the user's skull and cerebral vertebra, and any injury to the user's brain, skull base or vertebra.

The major breakthrough of this invention lies in that; it produces a protective helmet without a hard shell. However, the soft-shell protective helmet needs to absorb the impact force in order to protect the user's head. The main innovation of this invention lies in how to discard the hard shell, but still retain the protective functions of conventional helmets. Therefore, the main consideration is the performance of the helmet in protecting the user's head. Secondly, a review must be made on the shortcomings of conventional helmets, such as inability to stay complete and tight contact belt with the user's head, clumsy weight, and poor portability. Besides, we must review the ways the conventional helmets are produced.

In the process of research and development, the conventional helmet must be re-designed. The inventor has full understanding of how a impact force on the inflexible construction from an impact can be transmitted to the user's skull and cerebral vertebra of hard-shelled helmets In various tests, the inventor has developed the concept of fundamental protruded blocks alike the hawksbill turtle shell, by dividing the skull part into several fundamental protruded blocks, so that the impact energy can be absorbed. Besides, the inventor has designed an innovative fabrication to assemble the fundamental protruded blocks to become a protective helmet with assured protection of the user's head.

As disclosed in the innovative fabrication of this invention of "Soft Shell Protective Head Gear and Fabrication Method", it involves the insertion of regular foam rubber and hard plastic platelets between an external layer and an bottom layer, which are then hot-compressed to form fundamental protruded blocks, then cut and sewn with a rim and fixing accessories to become a protective head gear that looks like a hawksbill turtle shell but without a hard shell.

Figure 2:
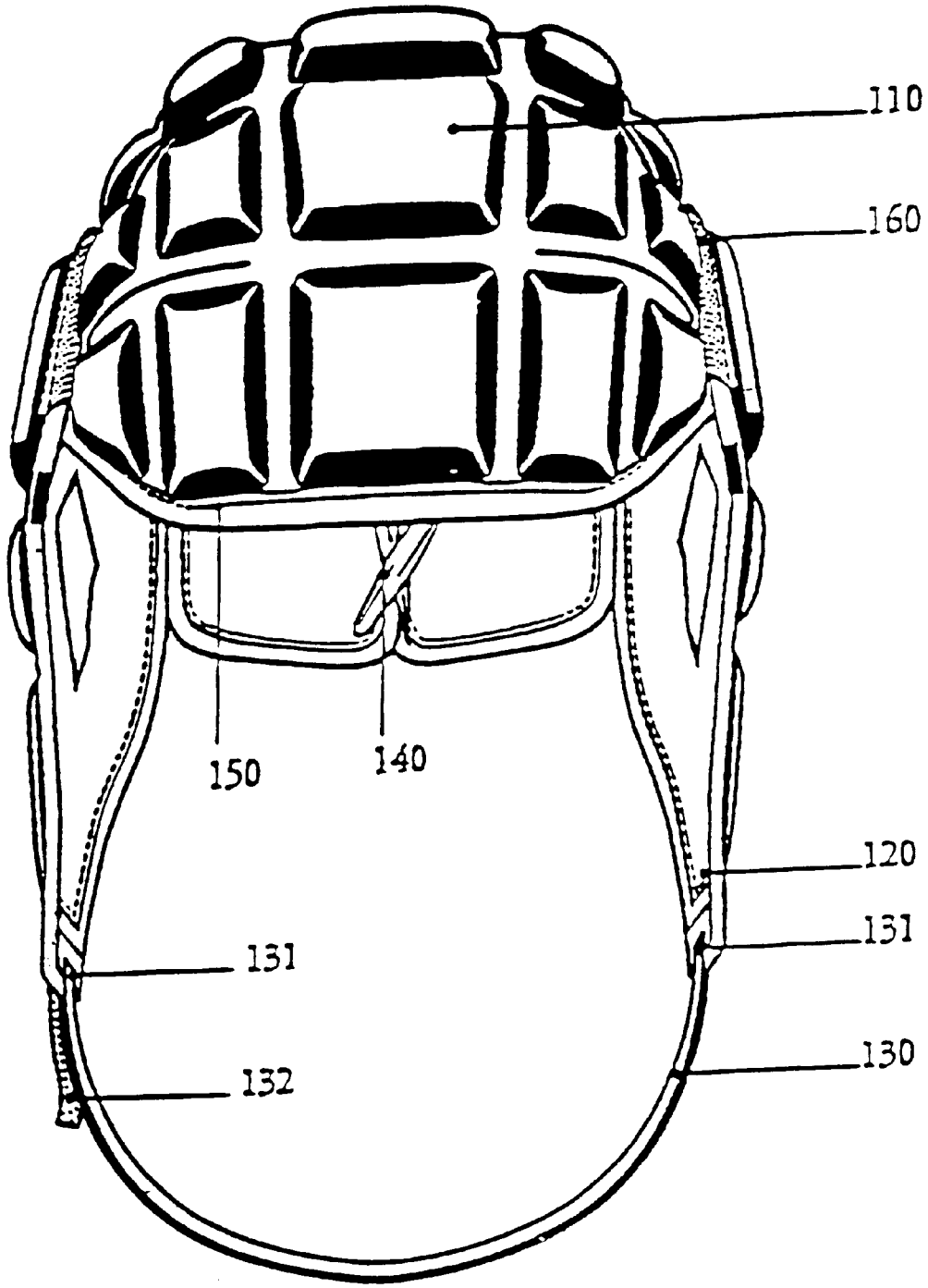
FIG. 2 is a perspective view of assembled protruded blocks.

The regular foam rubber mentioned above refers to PU foam rubber and PU inertia shock-absorption foam rubber available on the market, or foam rubber and shock-absorption inertia foam rubber of other foaming materials. The plastic platelets mentioned above refer to hard plastic platelets and flexible thin plates available on the market. Said foam rubber and hard plastic platelets are cut in advance to become the fundamental protruded blocks as illustrated in FIG. 1. Then, they are hot-compressed to form the protective headgear without hard shell as illustrated in FIG. 2. Many fundamental protruded blocks are protruded to present an appearance like a hawksbill turtle shell. Without a hard shell, the entire flexible headgear can be folded for storage convenience. The external layer of the soft shell headgear can be printed with all kinds of color or patterns to suit the user's needs, to enhance living pleasure, to match with the user's clothing or achieve visual enjoyment.

Figure 3:
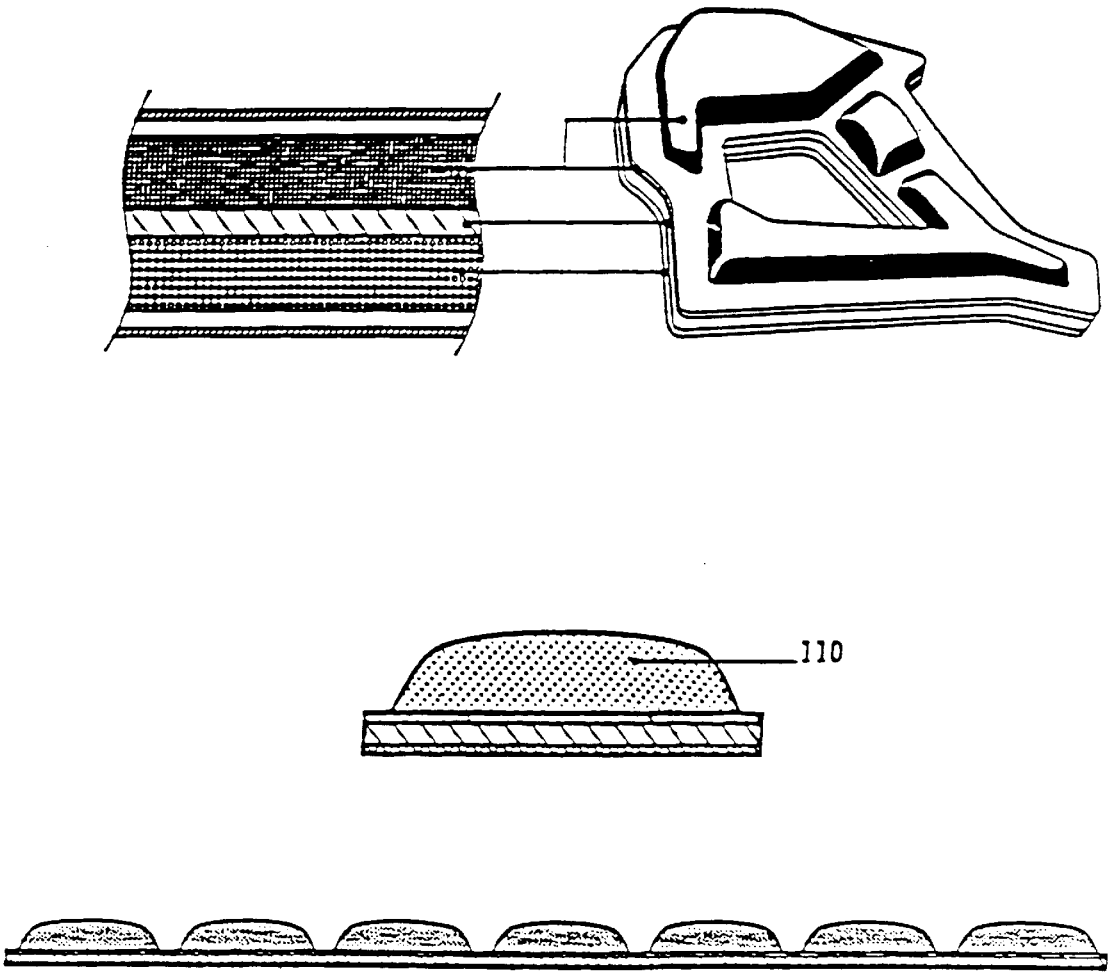
FIG. 3 is a section view of the fundamental protruded blocks.
Figures 1, 4:
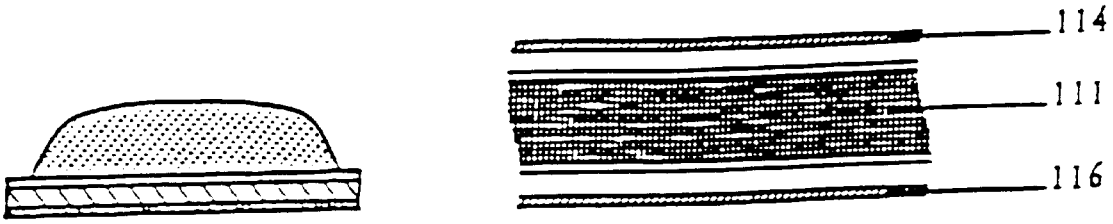
FIG. 4 illustrates section view taken from A—A of the fundamental blocks.
Figures 2, 4:
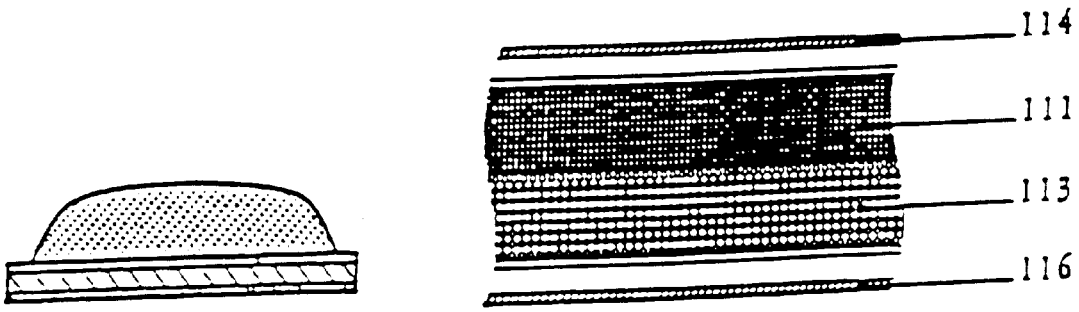
Figures 3, 4:
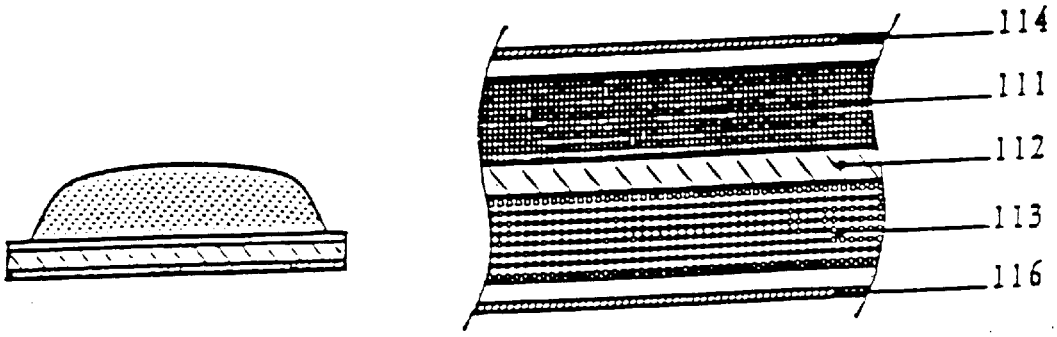

FIG. 3 illustrates a section view of the detailed structure of fundamental blocks of the "soft shell protective head gear". The soft shell headgear is composed of shock-absorption inertia foam rubber, foam rubber and hard plastic platelets that are spaced from each other to become a headgear without a hard shell. The section taken from A—A is divided into three diagrams, FIG. 4-1 to FIG. 4-3. FIG. 4-1 refers to a single-layered shock-absorption foam rubber or a regular foam rubber layer structure, wherein the external layer part 111 of inertia shock-absorption foam rubber or regular foam rubber is inserted between an external layer 114 and a bottom layer 116. FIG. 4-2 refers to a double-layered foam rubber layer structure, wherein the external layer part 111 of shock-absorption foam rubber or regular foam rubber and the internal layer part 113 of shock-absorption foam rubber or regular foam rubber are inserted between the external layer 114 and the bottom layer 116. FIG. 4-3 refers to a multiple-layered foam rubber layer structure with the addition of hard plastic platelets 112, wherein there is an external layer 114 on top of the external layer part 111, of inertia shock-absorption foam rubber or regular foam rubber and a hard plastic platelet 112 at the bottom. AT the bottom of the hard plastic platelet is the internal layer part 113 of inertia shock-absorption foam rubber or regular foam rubber and . At the bottom of the internal layer part of inertia shock-absorption foam rubber or regular foam rubber is a bottom laser 116.

The soft shell head gear produced in accordance with this invention of "soft shell protective head gear production method" comprises the following:

An external layer and a bottom layer;

A main protrusion, with a tightening band running through a tightening hole or a two-way elastic band sewn onto it, so the split tail can be closely in contact; this tightening band or two-way elastic band has extendable resilience. So it is suitable for different skull sizes of different users.

Two protruded ear blocks, below which are fastening bands, one end passing through a band ring at the end of the ear block, while the end of the fastening band is connected to a part of a fixing ring. Another ear block is structured in the same way; the ear block is fastened to the main protrusion by a connecting band.

Figure 5:
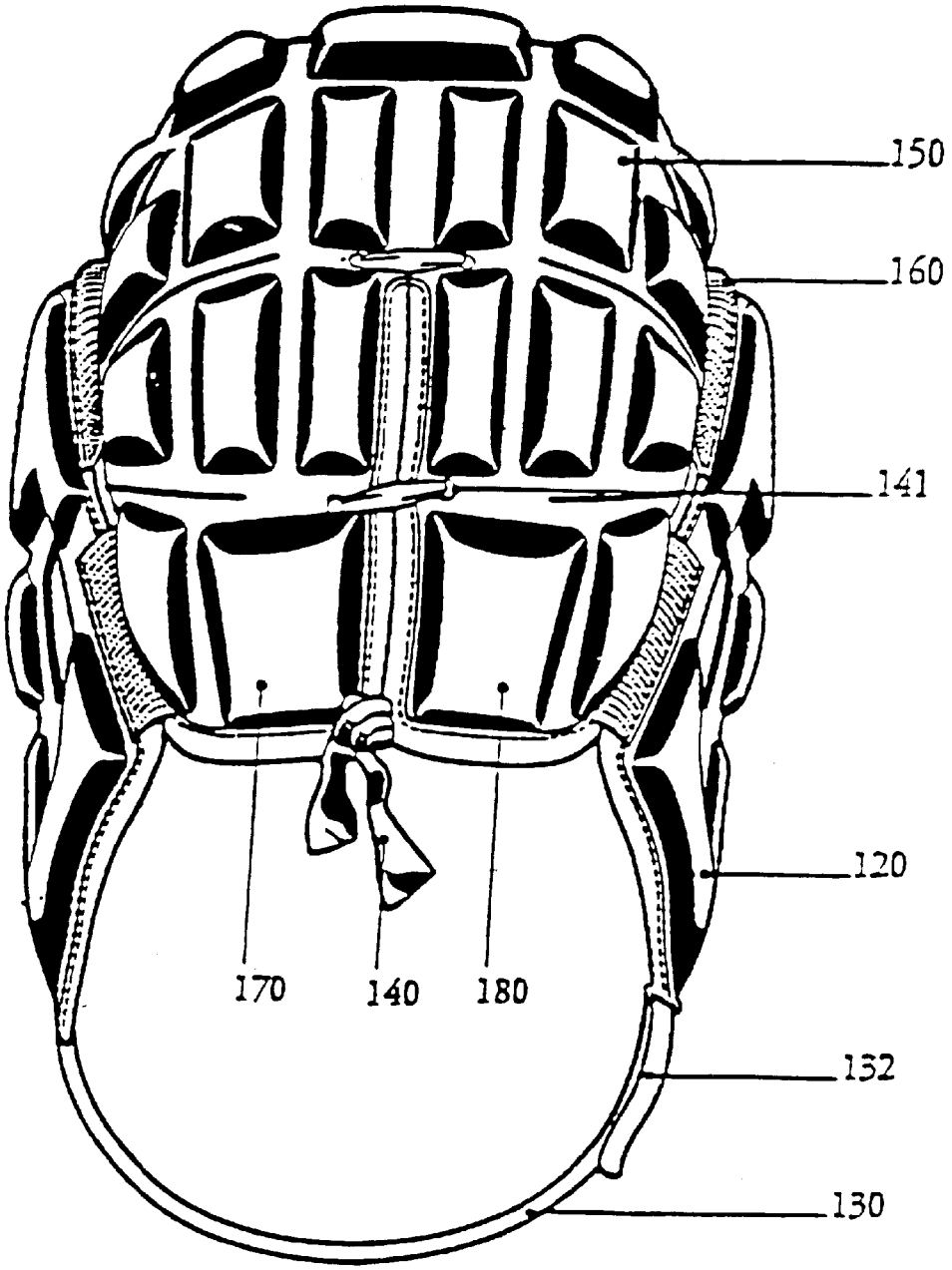
FIG. 5 is a rear view of the "soft-shelled protective helmet".
Figure 6:
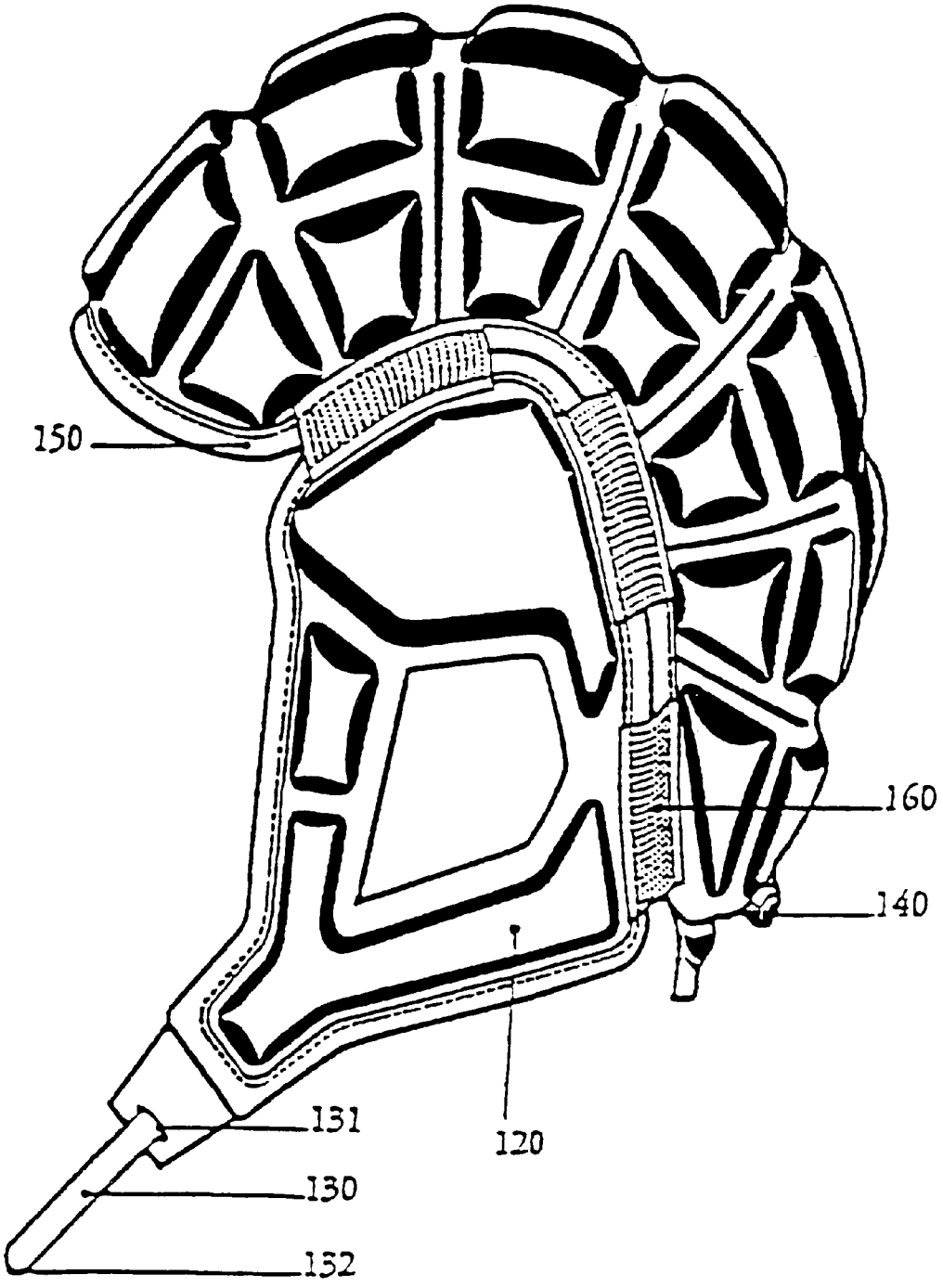
FIG. 6 is a side view of the "soft-shelled protective helmet".

FIG. 2 is a perspective view of the assembled "soft shell protective head gear", wherein, part number 110 is the fundamental protruded block, 120 is the protruded ear block, 130 is the fixing band, 140 is the tightening band, 160 is the elastic connecting band, and 150 is the main protrusion. As shown in FIG. 1, the fundamental protruded blocks are made by hot-compression forming process and are cut them into several pieces. The protruded ear block 120 is fastened by several pieces of connecting band 160 to the main protrusion 150. One end of the fixing band 130 passing through the band ring 131, the end of the fixing band 130 connected to a part of the fixing ring 132, and the end of the other fixing band 130 is connected to another part of the fixing ring 132. Meanwhile, referring to the rear view in FIG. 5 and the side view in FIG. 6, the tail ends 170, 180 of the main protrusion are cut and split from the fundamental protruded block; by passing the tightening band 140 through the tightening hole 141, the tail ends 170, 180 of the split block are brought into contact, to complete the "soft shell protective head gear".

In the fundamental protruded blocks of this invention of "soft shell protective head gear', either one or the combination of more than one of the three ingredients, shock-absorption inertia foam rubber, foam rubber and hard plastic platelet, can be used in the production. The arrangement of the selected ingredients of shock-absorption inertia foam rubber, foam rubber and hard plastic platelets can be adjusted freely at will. For example, there is the plastic platelet 112 on top of the external layer part 111 of regular foam rubber, and the internal layer part 113 of regular foam rubber at the bottom of the external layer part 111 of regular foam rubber. This structure can be applied to soccer players who may use their heads to pass the incoming ball to other directions.

This invention has disclosed an alternative fabrication of the "soft shell protective head gear fabrication", wherein either the shock-absorption inertia foam rubber, foam rubber and hard plastic platelet can be spaced from each other, or a single ingredient can be used, as shown in the section view of fundamental blocks in FIG. 4-1 to FIG. 4-3 by selecting one to several foam rubber layers, or with or without the addition of hard plastic platelets. The fundamental blocks of said "soft shell protective head gear" can be made from various combinations of different ingredients to suit actual requirements, so the final products of soft shell protective head gear will provide different protective effects through the selection of different ingredients.

Because of the characteristics of the interior structure, and mixed components of the fundamental blocks of the "soft shell protective head gear", a different structure of soft shell protective head gear can be chosen freely by the user to suit his or her own requirements, whether the user is a motorcycle rider, horseback rider, a sportsman, a car driver or passenger, or a bicycle rider. In the section view of the fundamental block we can see the performance of the soft shell protective headgear structure. FIG. 4-3 illustrates a multiple-layered sponge layer structure with the addition of hard plastic platelets 112, which can be used by motorcycle riders, or heavy-impact sports such as ice hockey, soccer, rugby, football, ice-skating, taekwondo, etc. FIG. 4-2 illustrates a double-layered sponge layer structure including a shock-absorption foam rubber external layer part 111 and a shock-absorption foam rubber internal layer part 113, which is suitable for car passengers who prefer comfort to other features. FIG. 4-1 illustrates a structure of single-layered shock-absorption external layer part 111, which is suitable for bicycle riders and in-line skaters.

Whether a motorcycle rider or a sportsman wearing this invention of "soft shell protective headgear", the fixing ring 132 on the fixing band 130 are provided to ensure that the entire headgear is in close contact with the user's head. Due to the elastic resiliency of the tightening band 140 and the connecting band 160, the user wearing the soft shell protective headgear can enjoy best comfort. When subjected to outside force, the impact on a certain protrusion area is absorbed by the shock-absorption foam rubber external layer part 111, so it will not extend to a larger area, while the soft shock-absorbing internal layer part 113 covering the user's head prevents the impact from the outside force. The shock-absorption foam rubber used in the soft shell protective headgear could absorb the impact when subjected to a speedy force. After the compression from outside force is alleviated, the shock-absorption foam rubber will automatically resume its original condition, providing excellent protection to the user. This advantage is not found in any conventional helmets.

In conclusion, this invention has its practical performance, novelty and inventive step. Though this invention is disclosed above in the preferred embodiment, which should not be based to restrict the spirit of this invention, anyone skilled in the art making modifications or variations deriving from the above description should be incorporated in the intent and spirit of the subject claim.

The following preferred embodiments further explain the fabrication of this invention, as well as the anticipated performance of the final product.

Preferred Embodiment (1)

Insert a single layer of sponge easily available on the market between the external layer and the bottom layer, which, is then processed with hot-compression to become the fundamental protruded blocks. The fundamental blocks are respectively cut into several pieces, and then the margins are sewn and fixed with accessories, to fasten the ear blocks to the main protrusion with several pieces of connecting band. Then, pull one end of the fixing band through the band ring, and connect the end of the fixing band to a part of the fixing ring, then, connect the end of the fixing band at the other side to another part of the fixing ring. Pull the tightening band through the tightening hole or sew the two-sided elastic band to connect the split tail of the main protrusion.

Preferred Embodiment (2)

Insert a single layer of sponge and plastic platelet easily available on the market between the external layer and the bottom layer, which, is then processed with hot-compression to become the fundamental protruded blocks. The fundamental blocks are respectively cut into several pieces, and then the margins are sewn and fixed with accessories, to fasten the ear blocks to the main protrusion with several pieces of connecting band. Then, pull one end of the fixing band through the band ring, and connect the end of the fixing band to a part of the fixing ring, then, connect the end of the fixing band at the other side to another part of the fixing ring. Pull the tightening band through the tightening hole or sew the two-sided elastic band to connect the split tail of the main protrusion.

Preferred Embodiment (3)

Insert a single layer of sponge easily available on the market between the external layer and the bottom layer, which, is then processed with hot-compression to become the fundamental protruded blocks. The fundamental blocks are respectively cut into several pieces, and then the margins are sewn and fixed with accessories, to fasten the ear blocks to the main protrusion with several pieces of connecting band. Then, pull one end of the fixing band through the band ring, and connect the end of the fixing band to a part of the fixing ring, then, connect the end of the fixing band at the other side to another part of the fixing ring. Pull the tightening band through the tightening hole or sew the two-sided elastic band to connect the split tail of the main protrusion.

What is claimed is:

1. A soft shell protective head gear, in the appearance of a hawksbill turtle shell, comprising the following:

an external layer and a bottom layer;

a main protrusion, with a tightening band passing through a tightening hole or with a two-sided elastic band sewn thereto, so that a split tail defined by the main protrusion can be in close contact;

two protruded ear blocks, below which is a fixing band, one end of which pulling through a band ring at the end of the ear block, the end of the fixing band being connected to a part of a fixing ring; the other ear block being of the same construction, the protruded ear block being fastened to the main protrusion by a connecting band.

2. The soft shell protective head gear as claimed in claim 1, wherein the surface of the external layer and bottom layer can be painted with any color drawing.

3. The soft shell protective head gear as claimed in claim 1, wherein the external layer and bottom layer are made of optional combination of available woven fabrics and plastic fabrics.

* * * * *